US005676075A

United States Patent [19]

Chen

[11] Patent Number: 5,676,075

[45] Date of Patent: Oct. 14, 1997

[54] PRESSER FOOT COUPLER FOR SEWING MACHINES

[76] Inventor: Shih-Chung Chen, No. 55, Ming-Te Road, Te-Yin Tsun, Wu-Guu Shiang, Taipei Hsien, Taiwan

[21] Appl. No.: 650,776

[22] Filed: May 20, 1996

[51] Int. Cl.[6] ..... D05B 29/12

[52] U.S. Cl. ..... 112/240

[58] Field of Search ..... 112/235, 240, 112/236, 239, 475.14, 139, 143, 60, 61

[56] References Cited

U.S. PATENT DOCUMENTS

| | | | |
|---|---|---|---|
| 3,098,460 | 7/1963 | Yoshida | 112/235 |
| 3,259,090 | 7/1966 | Howell | 112/240 |
| 3,457,889 | 7/1969 | Killinger et al. | 112/240 |
| 3,858,538 | 1/1975 | Van Amburg | 112/235 |

FOREIGN PATENT DOCUMENTS

| | | | |
|---|---|---|---|
| 93165 | 8/1958 | Denmark | 112/240 |
| 4024066 | 1/1992 | Japan | 112/240 |

*Primary Examiner*—Ismael Izaguirre

*Attorney, Agent, or Firm*—Bacon & Thomas

[57] ABSTRACT

A presser foot coupler for a sewing machine allows effortless and quick mounting and dismounting of a presser foot onto the sewing machine. The presser foot coupler comprise a holding member having a receding coupling portion formed on the bottom and a sliding channel formed on one side, and a locking member slidably inserted in the sliding channel on the holding member so as to allow the presser foot to be locked in position with the holding member. To allow a presser foot to be mountable on the presser foot coupler according to the present invention, the presser foot should be formed with at least a projecting coupling portion on the top. The receding coupling portion on the holding member then allows the presser foot to be coupled to the holding member by inserting the projecting coupling portion into the receding coupling portion. Either the dismounting or the mounting is quite effortless and quick to do, thus allowing very easy replacement of the presser foot on the sewing machine.

5 Claims, 5 Drawing Sheets

PRESSER FOOT COUPLER FOR SEWING MACHINES

BACKGROUND OF THE INVENTION

1. Field of the Invention

The present invention relates to sewing machines, and more particularly to a detachable presser foot coupler that allows effortless and quick replacement of various types of presser foots on a sewing machine.

2. Description of Related Art

A presser foot is a forked, metal device on a sewing machine used for holding the fabric being stitched securely in place. FIG. 9 shows a perspective view of a conventional presser foot coupler which is constructed with a holding member 1*a* that holds a forked member 2*b* by means of a pin 3*c*. The holding member 1*a* is formed with a hole 11*a* and a slot 12*a* that allow the holding member 1*a* to be clamped to a mounting bar on the sewing machine by means of a screw 41*a*. When a presser foot is to be attached to the coupler, the user needs to visually align the needle hole 24*a* with the needle 50*a* on the sewing machine while screwing tight the screw 41*a*, which is quite an ineffective, and usually laborious and inaccurate way of mounting the presser foot. Moreover, when another type of presser foot is to be used for a different type of fabrics or clothing, the replacement is also quite laborious to do and the foregoing alignment procedure has to be carried out again. This drawback would cause the user to spend too much time on the replacement. There exists therefore a need for a new presser foot coupler that allows effortless and quick mounting and dismounting of a presser foot on a sewing machine.

SUMMARY OF THE INVENTION

It is therefore a primary objective of the present invention to provide a presser foot coupler for a sewing machine which allows effortless and quick mounting and dismounting of a presser foot thereon for easy replacement of various types of presser foots for the sewing machine.

In accordance with the foregoing and other objectives of the present invention, a new and improved presser foot coupler for a sewing machine is provided. The presser foot coupler comprise a holding member having a receding coupling portion formed on the bottom and a sliding channel formed on one side, and a locking member slidably inserted in the sliding channel on the holding member so as to allow the presser foot to be locked in position with the holding member. To allow a presser foot to be mountable on the presser foot coupler according to the present invention, the presser foot should be formed with at least a projecting coupling portion on the top. The receding coupling portion on the holding member then allows the presser foot to be coupled to the holding member by means of inserting the projecting coupling portion into the receding coupling portion.

In use, the holding member is mounted permanently on the sewing machine. Various types of presser foots can be replaceably mounted on the presser foot coupler according to the present invention.

To mount a presser foot on the presser foot coupler, the user needs just to pull the locking member upwards by hand, insert the projecting coupling portion on the top of the foot presser into the receding coupling portion on the bottom of the holding member, and finally insert the locking member back into the sliding channel on the holding member.

To dismount the current foot member so as to replace it with a new one, the user needs just to pull the locking member upwards by hand, pull the current foot presser away from the holding member, insert the new foot presser into the receding coupling portion on the bottom of the holding member, and finally insert the locking member back into the sliding channel on the holding member. Either the dismounting or the mounting is quite effortless and quick to do, thus allowing very easy replacement of the presser foots.

BRIEF DESCRIPTION OF DRAWINGS

The present invention can be more fully understood by reading the subsequent detailed description of the preferred embodiments thereof with references made to the accompanying drawings, wherein.

DETAILED DESCRIPTION OF PREFERRED EMBODIMENT

Figure 1:
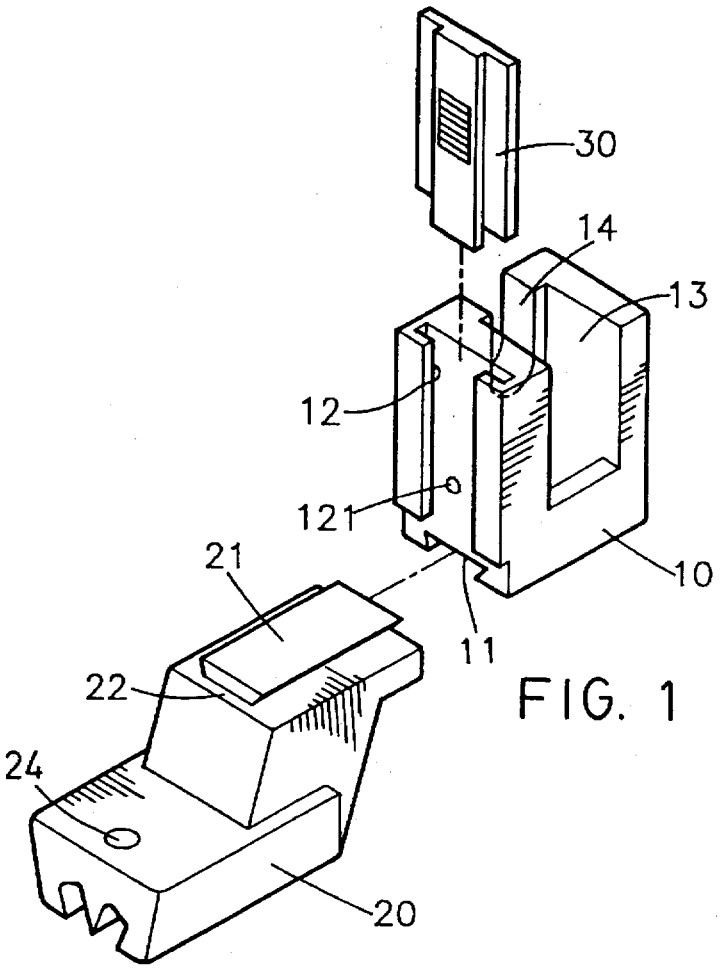
FIG. 1 shows an exploded perspective view of the first preferred embodiment of a presser foot coupler according to present invention.
Figure 3:
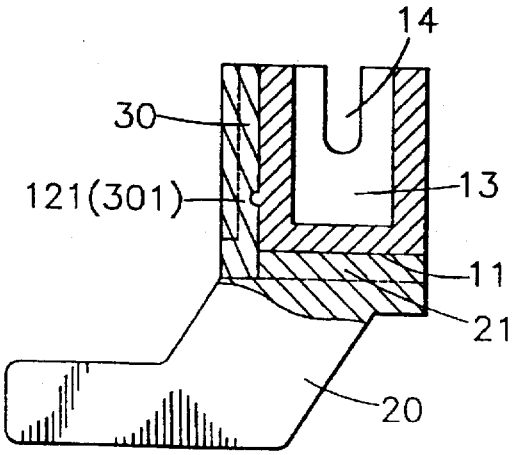
FIG. 3 shows a cross sectional view of the presser foot coupler of FIG. 1.
Figure 2:
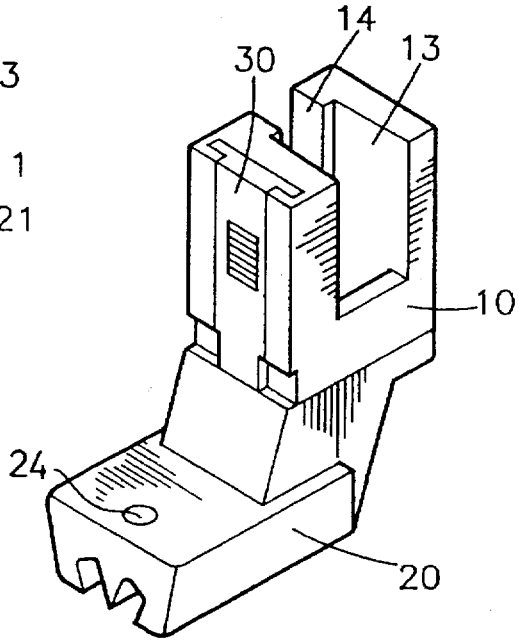
FIG. 2 shows a perspective view of the presser foot coupler of FIG. 1 when assembled.

FIG. 1 through FIG. 3 illustrate the first preferred embodiment of the presser foot coupler according to present invention, which is composed of three separate parts: a holding member 10, a presser foot 20, and a locking member 30. The presser foot 20 is coupled to the holding member 10 by means of a projecting coupling portion 21 formed on the top of the presser foot 20 which can be inserted sideways into a receding coupling portion 11 of a matching shape formed on the bottom of the holding member 10. A margin 22 is left between one end of the projecting coupling portion 21 and the edge of the top surface of the presser foot 20. In order to allow the presser foot 20 to be coupled tightly to the holding member 10 without loosening up, the holding member 10 is formed with a sliding channel 12 that can receive the locking member 30 therein. As illustrated in FIG. 2 and FIG. 3, after the presser foot 20 is coupled in position to the holding member 10 by means of inserting the projecting coupling portion 21 of the presser foot 20 into the receding coupling portion 11 of the holding member 10, the locking member 30 is inserted into the sliding channel 12 on the holding member 10 with the bottom end of the locking member 30 abutting the margin 22, thereby stopping the presser foot 20 from being withdrawable from the holding member 10. Moreover, so as to further allow the locking member 30 to be more firmly mounted in position without being loosened up due to vibration of the sewing machine during operation, a dome-like protrusion 121 is provided on the wall in the sliding channel 12 and, correspondingly, a receding portion 301 of a matching shape is provided on the back of the locking member 30 as illustrated in FIG. 1 and FIG. 3. When the locking member 30 is inserted in position on the holding member 10, the receding portion 301 receives the dome-like protrusion 121 therein, thus allowing the locking member 30 to be firmly secured on the holding member 10.

To replace the presser foot 20 with a new one, the user needs just to pull the locking member 30 upwards away from the sliding channel 12 by hand and then the presser foot 20 can be uncoupled from the holding member 10 by pulling it also by hand. In addition, the holding member 10 is provided with a void portion 13 on the top and a slot 14 on a sidewall that surrounds the void portion 13.

Figure 4:
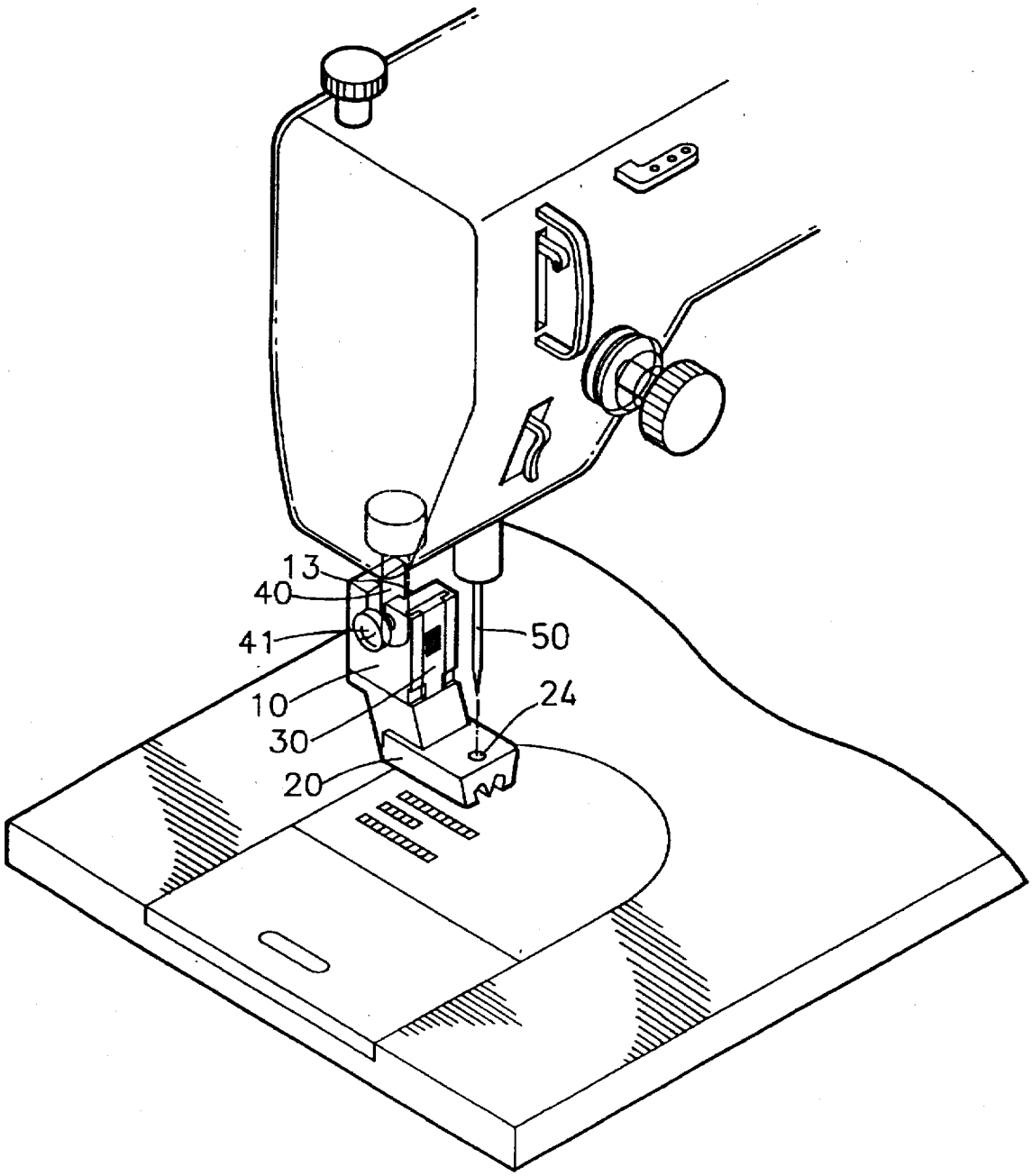
FIG. 4 shows a perspective view of a sewing machine utilizing the presser foot coupler according to the present invention.

Referring also to FIG. 4, a mounting bar 40 having a threaded hold is suspended on the sewing machine. With this provision, the holding member 10 can be mounted on the sewing machine by using a screw 41 that screws through the slot 14 on the holding member 10 into the threaded hole on the mounting bar 40, thereby clamping the holding member 10 securely to the mounting bar 40 on the sewing machine. When mounted in position, a needle hole 24 formed through the presser foot 20 is precisely aligned with the needle 50 on the sewing machine, allowing the needle 50 to make stitches on the fabric under the presser foot 20 through the needle hole 24. As a consequence, the alignment procedure for the needle can be eliminated.

Figure 5:
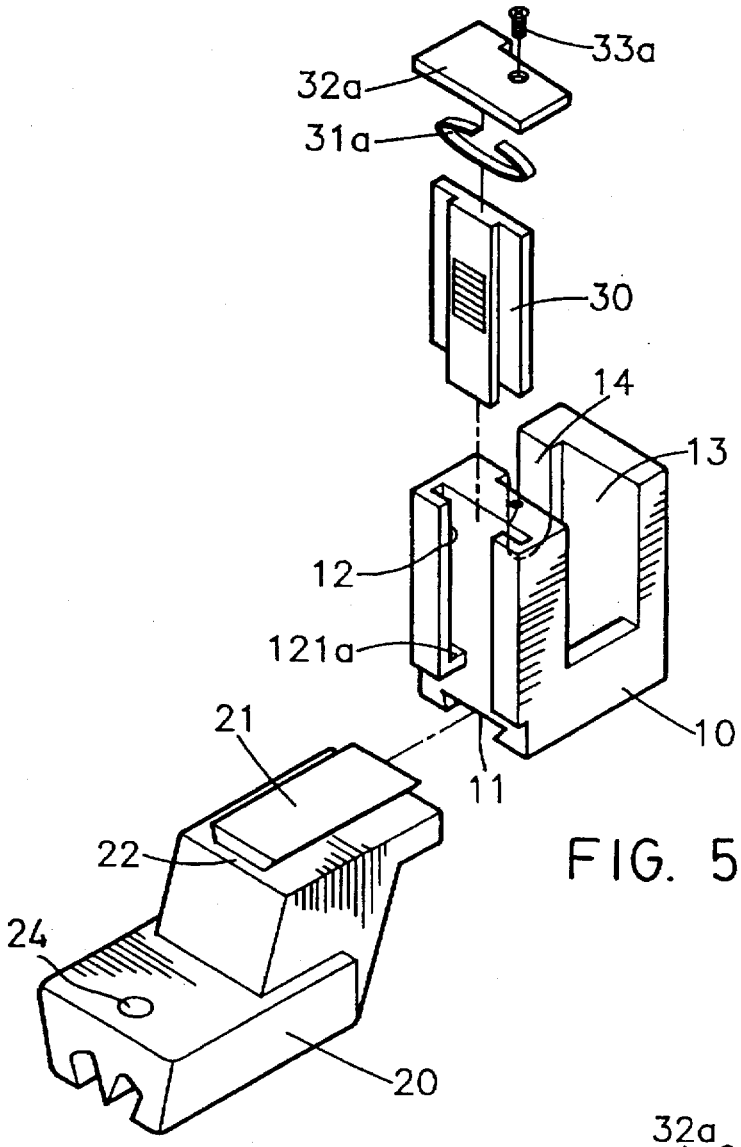
FIG. 5 shows an exploded perspective view of the second preferred embodiment of the presser foot coupler according to present invention.
Figure 6:
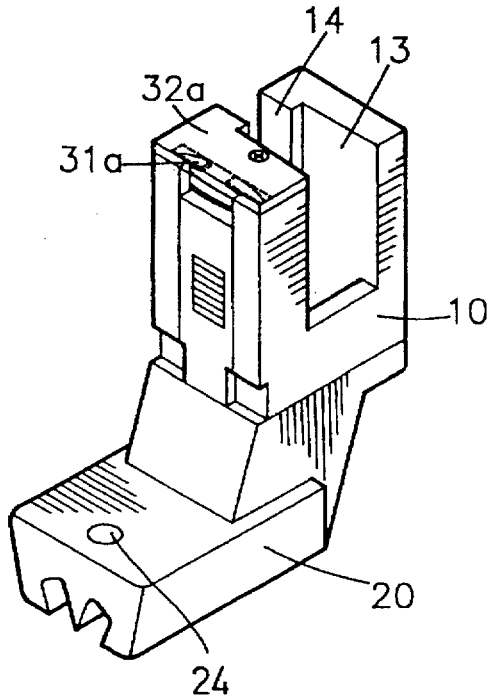
FIG. 6 shows a perspective view of the presser foot coupler of FIG. 5 when assembled.

Referring further to FIGS. 5 and 6, there are shown the second preferred embodiment of the presser foot coupler according to the present invention. This embodiment differs from the previous one in that the holding member 10 has its sliding channel 12 formed with a stopper portion 121*a* near the bottom so as to stop and support the locking member 30 when inserted in position in the sliding channel 12 and also in that an elastic piece 31*a* and a lid 32*a* having a threaded opening are provided in addition to the locking member 30. When the locking member 30 is inserted in position in the sliding channel 12, the elastic piece 31*a* is placed on the top edge of the locking member 30 and the lid 32*a* forcibly presses the elastic piece 31*a* against the locking member 30. The lid 32*a* then is secured tightly on the top of the holding member 10 by means of a screw 33*a* that screws through the threaded opening in the lid 32*a* to a threaded hole in the holding member 10, as illustrated in FIG. 6. This allows the locking member 30 to exert a pressing force on the presser foot 20, thus allowing the presser foot 20 to be more firmly coupled to the holding member 10.

To uncouple the presser foot 20 from the holding member 10, the user can unscrew the screw 33*a* so as to remove the lid 32*a* from the locking member 30 and then the locking member 30 from the sliding channel 12 on the holding member 10. After that, the presser foot 20 can be effortlessly pulled away by hand from the holding member 10, thus uncoupling the presser foot 20 from the holding member 10.

Figure 8:
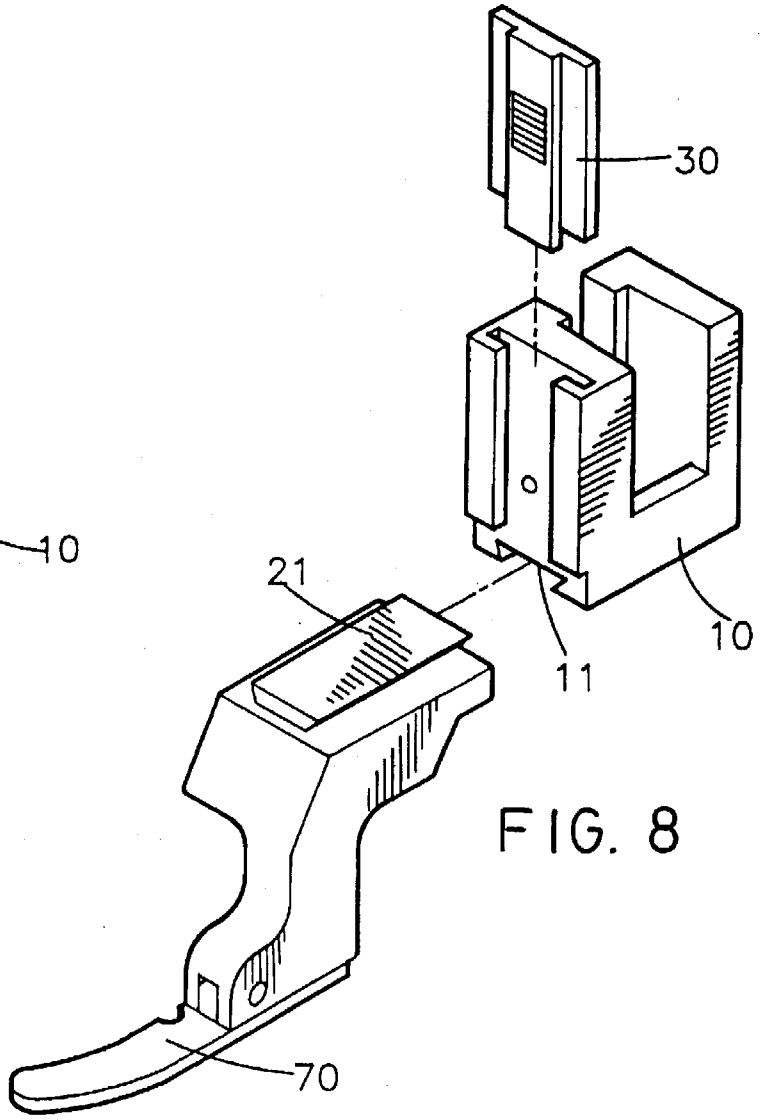
FIG. 8 shows an exploded perspective view of the presser foot coupler according to present invention when coupled with a single-leg presser foot.
Figure 7:
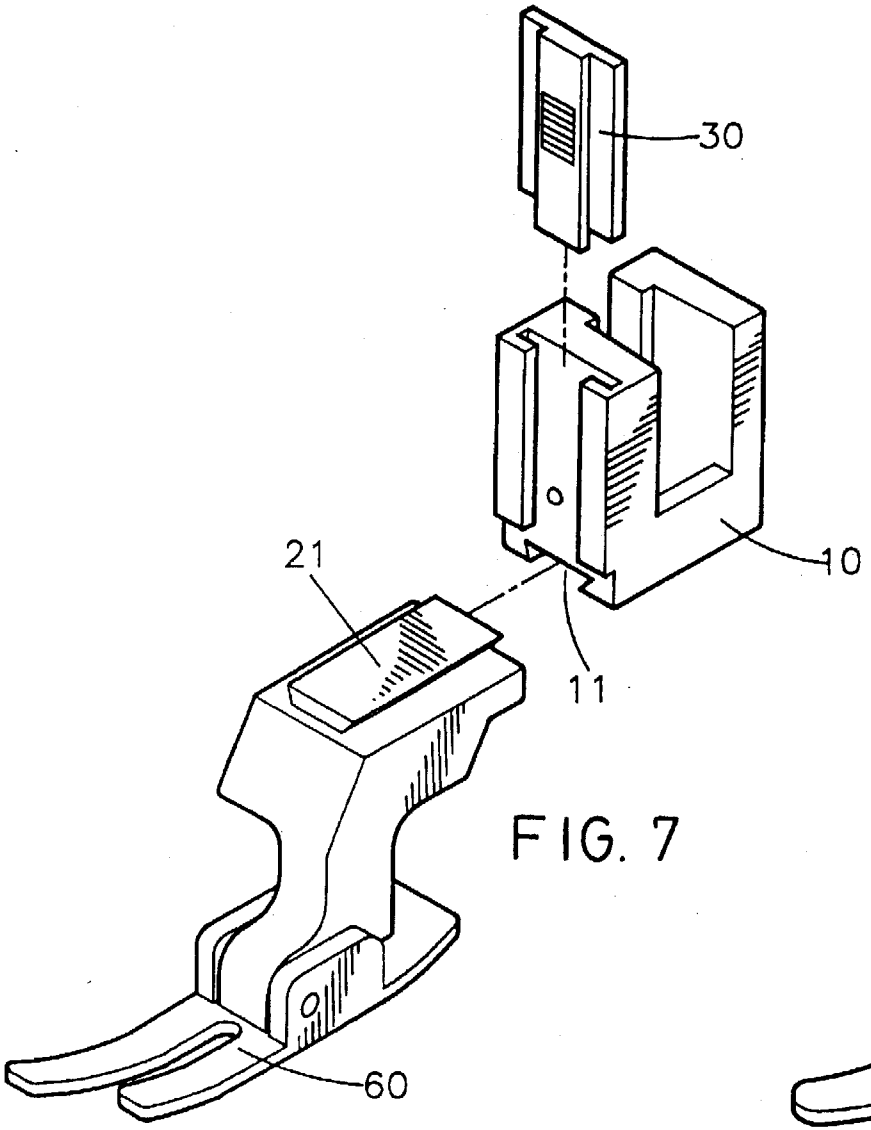
FIG. 7 shows an exploded perspective view of the presser foot coupler according to present invention when coupled with a double-leg presser foot.
Figure 9:
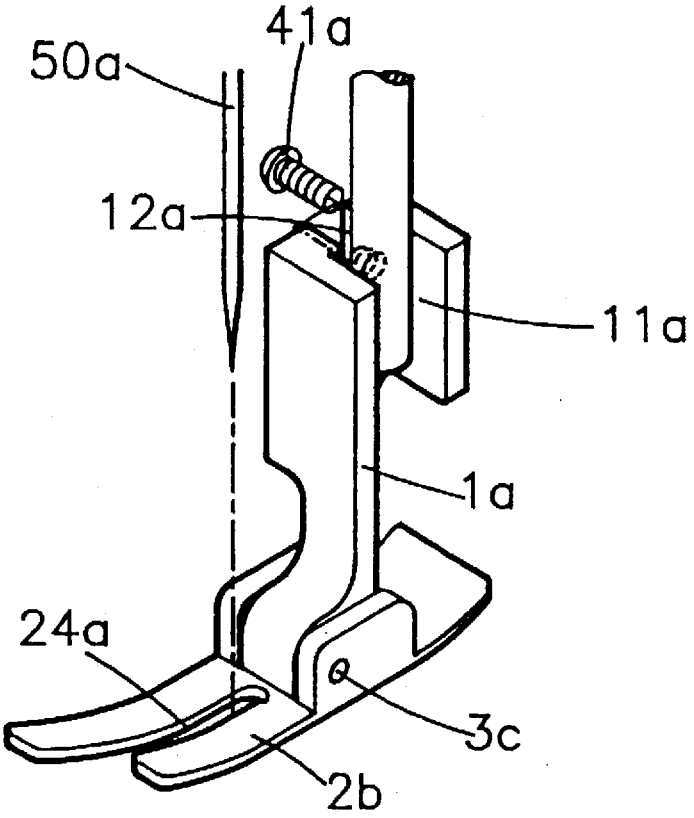
FIG. 9 (PRIOR ART)
FIG. 9 shows a perspective view of a conventional presser foot coupler.

In use, the holding member 10 is mounted permanently on the mounting bar 40 on the sewing machine. As shown in FIGS. 7 and 8, various types of presser foots can be replaceably mounted on the presser foot coupler according to the present invention, including, for example, a double-leg presser foot 60 as shown in FIG. 7 and a single-leg presser foot 70 shown in FIG. 8. In accordance with the present invention, these presser foots 60, 70 are each provided with a projecting coupling portion of a similar shape as the projecting coupling portion 21 described in the foregoing with reference to FIGS. 1, 2, and 3.

To mount a presser foot on the presser foot coupler, the user needs just to pull the locking member 30 upwards by hand, insert the projecting coupling portion 21 on the top of the foot presser 10 into the receding coupling portion 11 on the bottom of the holding member 10, and finally insert the locking member 30 back into the sliding channel 12 on the holding member 10.

To dismount the current foot member so as to replace it with a new one, the user needs just to pull the locking member 30 upwards by hand, pull the current foot presser away from the holding member 10, insert the new foot presser into the receding coupling portion 11 on the bottom of the holding member 10, and finally insert the locking member 30 back into the sliding channel 12 on the holding member 10. Either the dismounting or the mounting is quite effortless and quick to do, thus allowing very easy replacement of the presser foots.

The present invention has been described hitherto with exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. A presser foot coupler for mounting on a sewing machine comprising:

a presser foot being formed with at least a projecting coupling portion on a top;

a holding member having a receding coupling portion formed on a bottom and a sliding channel formed on one side, said receding coupling portion enabling the presser foot to be coupled to said holding member by means of inserting the projecting coupling potion into the receding coupling portion wherein said sliding channel is formed with a dome-like protrusion; and a locking member slidably inserted in said sliding channel on said holding member so as to enable the presser foot to be locked in position with said holding member, wherein said locking member is formed with a receding portion of a matching shape with said dome-like protrusion, said dome-like protrusion being coupled with said receding portion when said locking member is locked in position on said holding member.

2. A presser foot coupler as claimed in claim 1, wherein said holding member is formed with a void portion and a slot on the top, allowing said holding member to be clamped by means of a screw to a mounting bar on the sewing machine.

3. A presser foot coupler as claimed in claim 1, further comprising an elastic piece and a lid covering the top of said locking member when said locking member is locked in position on said holding member, said elastic piece allowing said locking member to exert a pressing force on the presser foot for firm securing of the presser foot on said holding member.

4. A presser foot coupler for mounting on a sewing machine comprising:

a presser foot being formed with at least a projecting coupling portion on a top;

a holding member having a receding coupling portion formed on a bottom and a sliding channel formed on one side, said receding coupling portion enabling the presser foot to be coupled to said holding member by means of inserting the projecting coupling portion into the receding coupling portion;

a locking member slidably inserted in said sliding channel on said holding member so as to enable the presser foot to be locked in position with said holding member; and, an elastic piece and a lid covering a top of said locking member when said locking member is locked in position on said holding member, said elastic piece allowing said locking member to exert a pressing force on the presser foot for firm securing of the presser foot on said holding member.

5. A presser foot coupler as claimed in claim 4, wherein said holding member is formed with a void portion and a slot on a top, allowing said holding member to be clamped by means of a screw to a mounting bar on the sewing machine.

* * * * *